United States Patent [19]

Oliver

[11] Patent Number: 4,635,455

[45] Date of Patent: Jan. 13, 1987

[54] CYLINDER LOCK

[75] Inventor: Roy N. Oliver, Salem, Va.

[73] Assignee: Medeco Security Locks, Inc., Salem, Va.

[21] Appl. No.: 756,791

[22] Filed: Jul. 19, 1985

[51] Int. Cl.[4] ..... E05B 15/14; E05B 27/04

[52] U.S. Cl. ..... 70/364 A; 70/378; 70/419; 70/409

[58] Field of Search ..... 70/362–366, 70/376–378, 392, 406–407, 409, 419–421

[56] References Cited

U.S. PATENT DOCUMENTS

| | | | |
|---|---|---|---|
| 2,097,407 | 10/1937 | Spinello | 70/364 A |
| 3,656,328 | 4/1972 | Hughes | 70/364 A |
| 4,424,692 | 1/1984 | Rousseau | 70/378 |

*Primary Examiner*—Robert L. Wolfe

*Attorney, Agent, or Firm*—Bernard, Rothwell & Brown

[57] ABSTRACT

A twisting tumbler lock with dual locking function has tumbler points at tumbler positions selectively offset forwardly or rearwardly and selectively rotatable to different angular positions to create an enormous number of keying combinations. A key according to the invention includes one or more bits which are offset forwardly or rearwardly of a corresponding tumbler axis.

19 Claims, 11 Drawing Figures

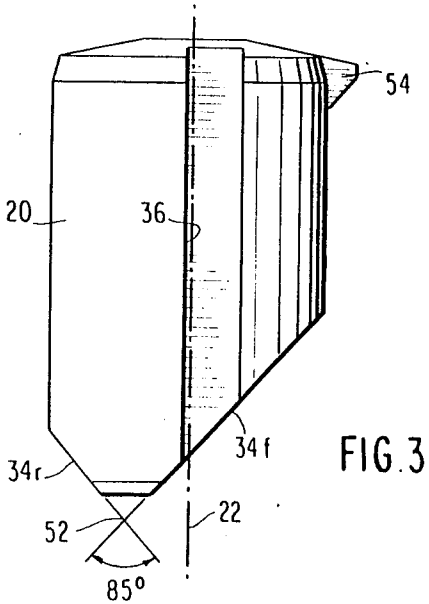
FIG. 3
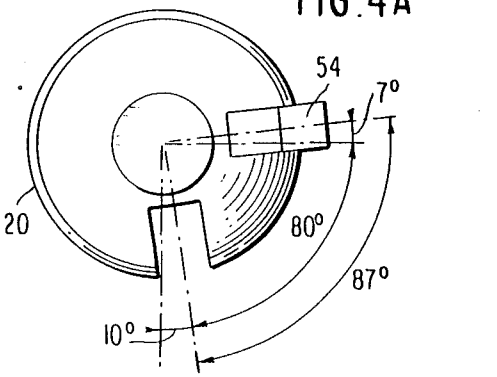
FIG. 4A
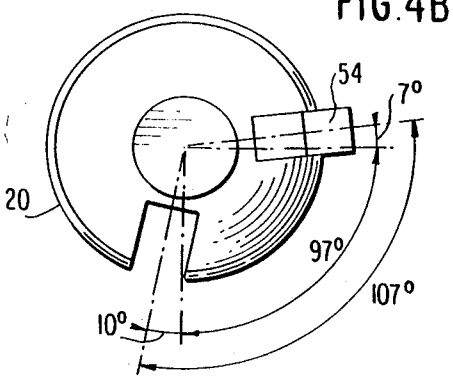
FIG. 4B
FIG. 5A
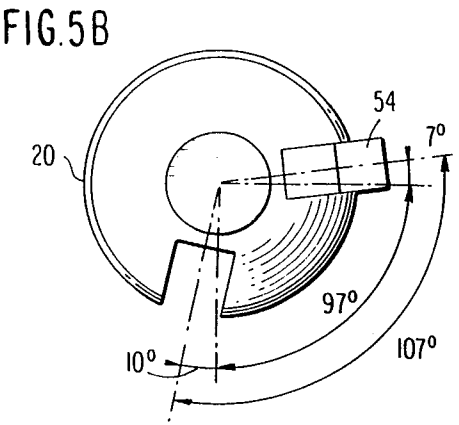
FIG. 5B
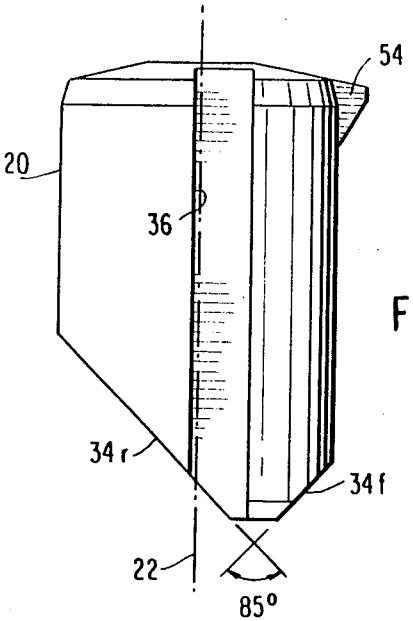
FIG. 5

CYLINDER LOCK

BACKGROUND OF THE INVENTION

1. Field of the Invention

This invention relates to improvements in cylinder locks and particularly to cylinder locks of the type having reciprocating and rotating tumblers.

2. Background Art

Twisting tumbler locks with dual locking mechanisms are embodied in the famous Medeco® locks manufactured by Medeco Security Locks, Inc. of Salem, Va., and as disclosed, for example, in U.S. Pat. No. Re. 30,198, reissued Jan. 29, 1980, and U.S. Pat. No. 3,722,240 granted Mar. 23, 1973 as well as the millions of Medeco locks made and sold since approximately 1970.

It is highly desirable to have as many key changes as possible for each type of cylinder lock. One of the advantages of the Medeco locks are that they provide a significantly greater number of actual key changes available from that previously known. Although the Medeco locks have been on the market for approximately 16 years, there has been no increase in the number of key changes and it was thought that none could be available.

Another highly desirable feature of a lock is its capability for master keying. One of the principal advantages of the Medeco lock disclosed in U.S. Pat. No. 3,722,240 is its ability to master key. However, it is desired to have even further and greater capability for master-keying.

SUMMARY OF THE INVENTION

This invention relates to improvements in the basic twisting tumbler dual-locking-type of lock cylinder known as a Medeco lock. Such cylinders have a plurality of pin tumblers each with chisel points on the tumbler tips so that the tumblers can be rotated as well as moved axially with a properly bitted key having straight and skew cuts. At each tumbler position the chisel point on the tip of the tumbler can be selectively offset relative to the axis of the tumbler either forward or rearward so as to create three additional potential bitting positions at each tumbler position, thus greatly increasing the bitting and combination possibilities. Moreover, the tumblers, instead of rotating through one predetermined angle in each direction, can be arranged to rotate through two different predetermined angles in each direction, thus creating further possibilities for permutations and combinations and increasing the possible bitting capability.

The key for use in the improved lock has generally V-cut bits which may be either perpendicular or skewed to the plane of the blade, but with the apex of the V either on the tumbler axis or forwardly or rearwardly of the tumbler axis. Master-keying may be provided by placing two such bits close enough to each other at each tumbler position to accommodate either a forward offset or a rearward offset tumbler.

BRIEF DESCRIPTION OF THE DRAWINGS

FIG. 3 is an elevation view of an individual tumbler with a rear offset point.

FIG. 4A is a top plan view of the tumbler in FIG. 3 for right-hand rotation.

FIG. 4B is a top plan view similar to FIG. 4A, but showing a tumbler for left-hand rotation.

FIG. 5 is an elevation view of a tumbler with a front offset point.

FIG. 5A is a top plan view of the tumbler of FIG. 5 for right-hand rotation.

FIG. 5B is a top plan view similar to FIG. 5*a* of a tumbler for left-hand rotation.

BRIEF DESCRIPTION OF THE PREFERRED EMBODIMENTS

Figure 1:
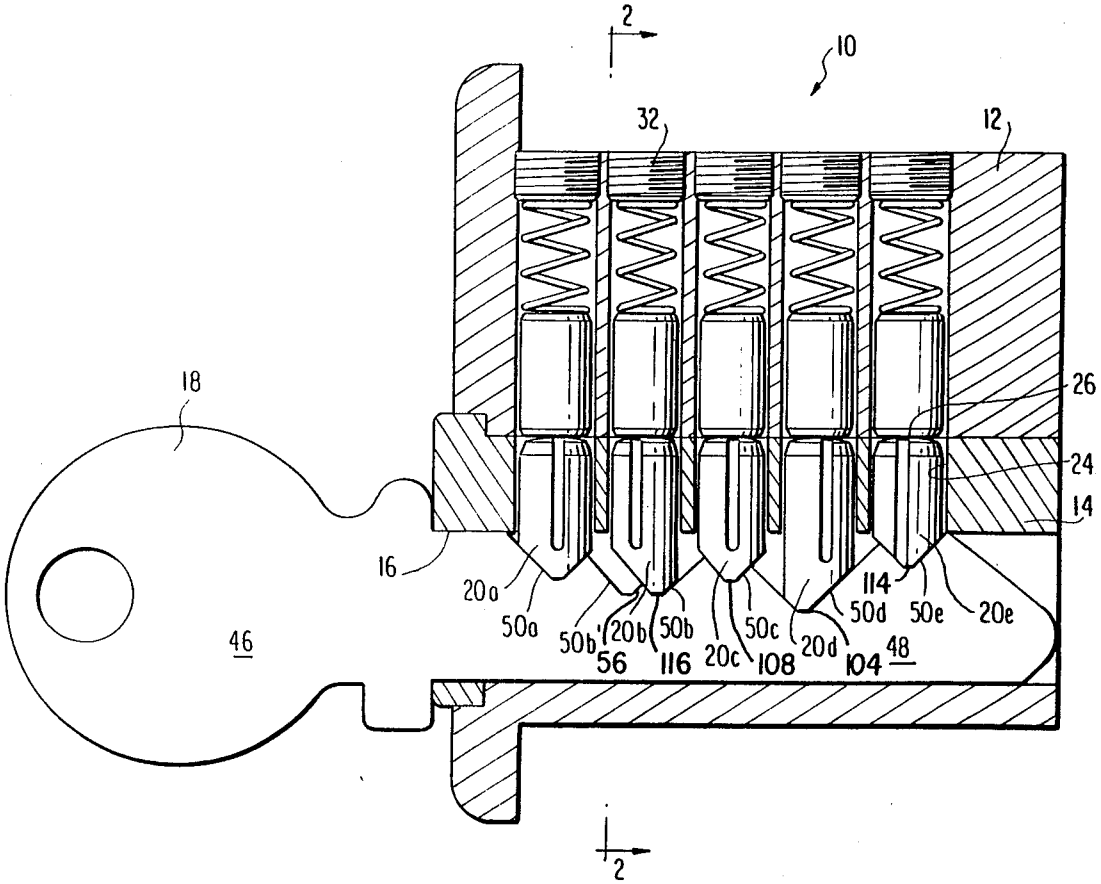
FIG. 1 is a sectional elevation view of an improved cylinder lock according to this invention.

FIG. 1 is a sectional elevation view of a twisting tumbler dual-locking cylinder of the Medeco-type. "Medeco-type" means locks of the type manufactured by Medeco Security Locks, Inc. of Salem, Va., and as shown for example in U.S. Pat. Nos. 3,722,240 and Re. 30,198. As such and in view of the well-known construction of the lock, components which are not changed in this invention from the standard Medeco® lock will not be described in great detail.

With reference to FIG. 1, a cylinder 10 of the Medeco-type has a conventional cylinder shell 12 with a cylinder plug 14 rotatably mounted therein. The cylinder plug has a keyway 16 of desired configuration to accommodate a key 18 having the same sectional configuration as the keyway.

A plurality of reciprocating and rotating tumblers 20 are provided, with one tumbler at each of five tumbler positions for the five pin tumbler lock shown in FIG. 1. Each twisting pin tumbler may reciprocate and rotate or oscillate about its longitudinal axis 22 in a corresponding pin tumbler hole 24 in the plug, see FIG. 2. When a properly bitted key is inserted, the tumblers are moved axially until the top of the tumblers are aligned along a shear line 26 tangent to the periphery of the plug. A plurality of drivers 28 are provided, one for each tumbler position, these drivers and tumblers are biased downwardly by springs 30 which abut against screw-threaded spring covers 32 as is known.

Each tumbler has on its bottom end a pair of downwardly tapered flat surfaces forming faces 34 of a chisel point. See FIG. 3 showing a rear offset tumbler pin with a long chisel face 34*f* and a short chisel face 34*r*. Other tumbler pins such as tumbler pin 20*c* of FIG. 1 would have chisel faces 34 of equal length, or could be offset forwardly of the tumbler pin axis.

As is known in the Medeco-type lock, each tumbler is provided with a true gate in the form of a slot 36 or equivalent configuration for cooperating with a side bar 38 or other known type of fence means. Springs not shown bias the side bar 38 away from the axis 22 of the tumbler. This side bar slides in slot 40. When a properly bitted key causes proper rotation of the tumblers and true gate, the outer edge 44 of the side bar is cammed by cam notch 42 on rotation of the plug 14 as is well known in connection with operation of the Medeco twisting tumbler dual-locking function cylinder lock.

Figure 6:
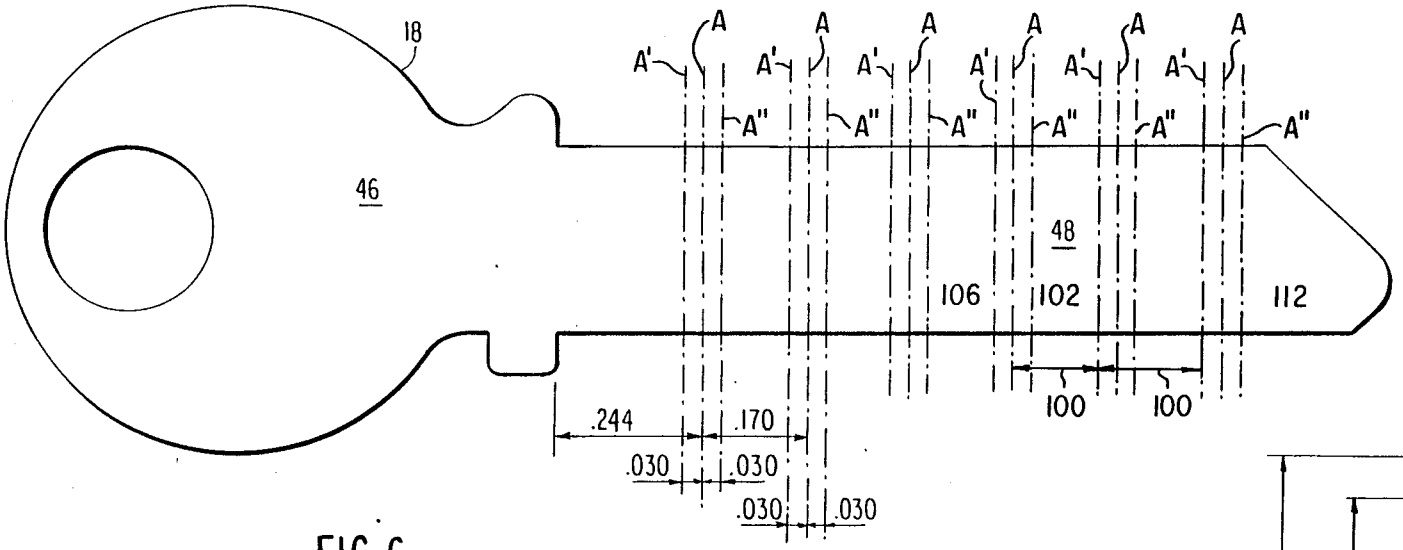
FIG. 6 is a diagrammatic view of a key showing the various possible bitting locations.
Figure 8:
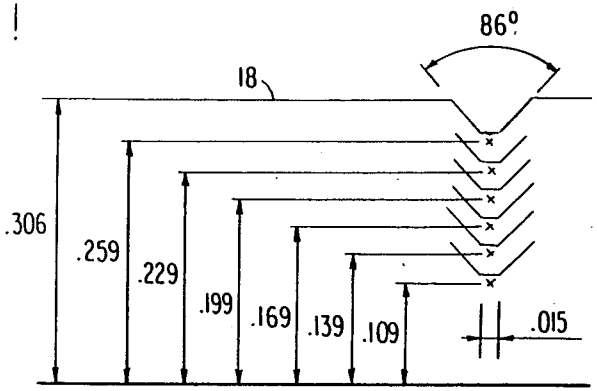
FIG. 8 is a sectional view taken along line 8—8 of FIG. 7.

The key 18 has a bow 46 and a blade 48 as is conventional for keys. However, the bitting includes a plurality of bits 50 which are V-shaped and as shown in FIG. 6, the apex of the V for each V-shaped bit at each tumbler position may be either on the center line of the tumbler position or offset forwardly or rearwardly, thus effectively providing three bit positions per tumbler position.

Figure 2:
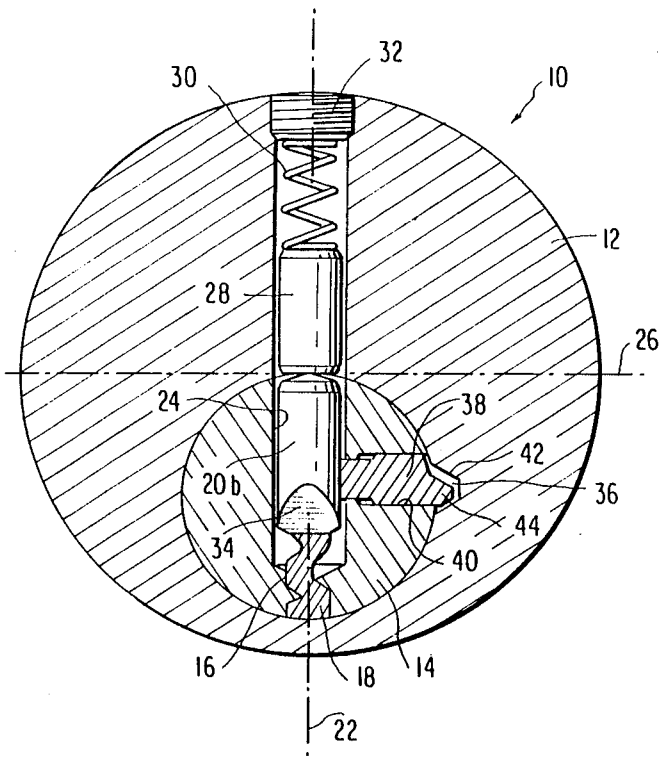
FIG. 2 is a sectional elevation view taken along line 2—2 of FIG. 1.

As is readily apparent from FIG. 2 viewed with reference to FIG. 1, a central longitudinal plane extends longitudinally through key blade 48, which central longitudinal plane passes through tumbler center line 22 of FIG. 2. The key bits of the blade are defined by generally V-shaped cuts in the key blade which cuts pass through the central longitudinal plane extending through the blade. Each V-shaped cut has an apex, and with reference to both of FIGS. 1 and 6, a distance 100 between an intersection 102 of apex 104 of one V-shaped cut with the central longitudinal plane of key blade 48, and an intersection 106 with the plane of apex 108 of an adjacent V-shaped cut, differs by a predetermined amount from a distance 110 between the apex intersection 102 and an intersection 112 of the apex 114 of another adjacent V-shaped cut. Thus bit 104 is offset toward the key bow of a "normal position" while bit 106 is not offset. Stated another way, each bit of the key is cut relative to a plurality of equally spaced bit centerlines A, with the apex 104 of at least one V-shaped cut of a bit being offset with respect to a corresponding bit centerline A by a predetermined amount. The apex can be offset towards the key bow 46 at a predetermined position A' relative to A, or can be offset away from the key bow 46 at a predetermined position A" relative to A. In the embodiment shown in FIG. 1, both apex 104 and apex 116 are offset of their respective bit centerlines, with apex 104 being offset towards bow 46 and apex 116 being offset away from bow 46. One or more of the V-shaped cuts can be skew cut, and one or more of the V-shaped cuts can be perpendicular relative to the longitudinally extending blade. See FIG. 7.

As shown in FIGS. 3 and 5, an extension of the chisel faces 34 of each tumbler is at a point line 52 and that point line may be offset a predetermined amount from the tumbler center line 22. The offset may be either a rear offset as in FIG. 3 or a forward offset as in FIG. 5. Additionally, there may be no offset, as for example tumblers 20*a* and 20*c* in FIG. 1.

Figure 7:
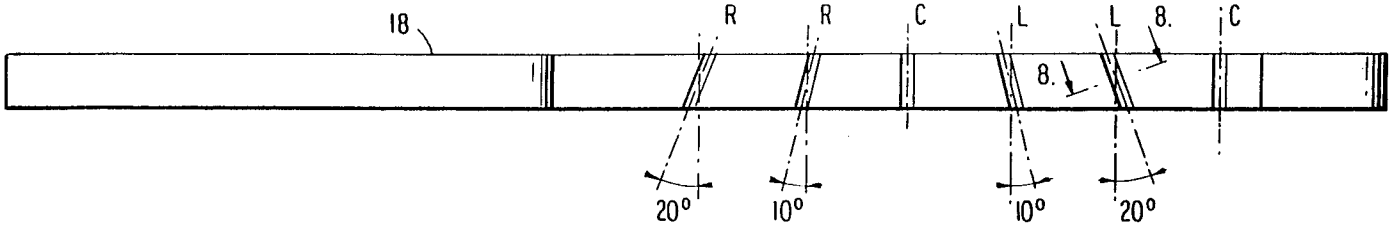
FIG. 7 is a top plan view of the key of FIG. 6.

Additionally, the skew cuts on the key may be either to the left side or right side as indicated L or R in FIG. 7 and may be at different angles, e.g., 10° or 20°, as indicated in FIG. 7. The skew cuts on the key are made to correspond to the rotation of the tumblers. Each tumbler pin has a tang 54 which cooperates with a broached slot (not shown but conventional in Medeco® locks) in the plug 14 and shell 12 to limit total rotation or spin of each tumbler in each direction of rotation to 20°.

By using a tumbler whose chisel point is offset 0.030" to the front or rear of the centerline of the tumbler in conjunction with locating the side bar slot at either a 10° or a 20° angle from parallel to the chisel point it is possible to manufacture four different and distinct tumblers which are different and distinct from a tumbler whose chisel point is located on the tumbler centerline. All five tumblers may be manufactured so that the direction of the 10° or 20° angle is to the left or to the right of perpendicular to the tumbler's longitudinal axis, thereby enabling the manufacture of ten different and distinct tumblers, and additionally a tumbler whose chisel point is perpendicular to the tumbler's longitudinal axis may be manufactured so that the chisel point is 0.030" to the front or rear of the centerline of the tumbler or on the centerline of the tumbler, thereby allowing the manufacture of thirteen different and distinct tumblers for each different length of tumbler manufactured. It is possible to manufacture eleven different length useable tumblers with each of these thirteen different tumblers thereby creating one hundred and forty three different and distinct tumblers. It is also possible to bit a key with a key cut which corresponds directly to one each of these one hundred and forty three tumblers in each bitting position of the key. Given a key with six bitting positions and considering the above determinations, the theoretical number of different and distinct lock and corresponding key combinations which are possible may be calculated by multiplying 143 to the sixth power which yields an answer of 8,550,986,578,849 theoretically possible key changes.

Moreover, the offset tumblers provide a unique possibility for increasing master key capability. As shown in FIG. 1 for example, at the second pin tumbler position, the key bit is cut offset forwardly at 50*b* but also offset rearwardly at 50*b*'. This leaves a small raised peak 56 which is high enough for either a forwardly offset or a rearwardly offset tumbler chisel face to locate on. With two V-shaped cuts adjacent, the bitting is W-shaped for master-keying in that particular tumbler position.

For example, the use of a tumbler with a chisel point which is offset 0.030" from the tumbler centerline forces the key cut on the key which corresponds to that tumbler to be positioned 0.030" to the front or rear of its normal position on the key. This offsetting of the key cut from its normal position makes it possible to bit the key in one bitting position with two different key cuts which may have the same depth dimension or may have depth dimensions which are different by as much as 0.030" and still operate the tumbler properly. Therefore, it is practical to have a key for a six tumbler lock which has twelve bittings which can be called a master key. This master key may be used to operate as many as sixty-four different cylinders, each of which is operated by a separate and distinct key which will operate only one cylinder, and does not require the use of master or split pins in any cylinder to accomplish this operation. Furthermore, the combination of this master key could only be determined by physically decoding a minimum of seven different cylinders or keys which were produced in sequence. While there are two key cut possibilities for each of the six tumbler positions, there is only one tumbler possibility per position. By multiplying the number of key cuts per position (two) to a power equal to the number of positions (6) the number of possible tumbler combinations (64) is obtained. The above principle combined with a master keying technique which does utilize master or split pins can yield a master key system which is theoretically capable of 18,750 different key combinations for each of the sixty-four tumbler combinations for a theoretical total of 1,200,000 change keys operable by one master key.

While the invention has been described in this preferred embodiment and primarily in reference to the side bar cylinder lock of Medeco U.S. Pat. No. Re 30,198, it is also applicable to the small diameter cylinder lock of Medeco U.S. Pat. No. 3,722,240 and other equivalents as would be apparent to those skilled in the art.

I claim:

1. A cylinder lock of the type having a cylinder shell, a key plug rotatably mounted in the shell, a plurality of chisel point pin tumblers in the key plug at a plurality of tumbler positions, at least one of the pin tumblers capable of reciprocatory and oscillatory movement about its axis, the tumblers being positionable with respect to each other along a shear line to provide one locking function, a fence means, the tumblers capable of oscillatory movement being positionable rotatably about their axis to block or free the fence means to provide a second locking function, the cylinder lock being usable with a proper bitted key having at least one V-shaped cut perpendicularly cut across a longitudinal axis of the key blade and at least one V-shaped cut skew cut across the longitudinal axis of the key blade, with improvements for creating an enormous number of possible key bit changes and master key combinations, the improvements comprising: selectively offsetting the chisel point for selected pin tumblers capable of oscillatory movement either forward or rearward of the tumbler axis, and positioning the V-shaped cuts on the key blade corresponding to such tumbler offset with the apex of the V similarly offset of the axis of the tumbler when the key is inserted into the cylinder lock.

2. A cylinder lock as in claim 1 further comprising providing at least one of the V-shaped cuts of the key at a tumbler position having an offset tumbler with another closely adjacent V-shaped cut so as to create a W-shaped cut for master-keying purposes.

3. A cylinder lock as in claim 2 further comprising at least four separate angles of skew cuts on the key blade.

4. A key for use with a cylinder lock according to claim 1 having twisting pin tumblers at least some of which have offset chisel points on their tips, the key including an integral key blade and key bow, the blade extending longitudinally from the bow and containing a plurality of key bits, each of the key bits being generally V-shaped cut, at least one of the V-shaped cuts being skew cut, with improvements comprising, the position of the apex of selected V-shaped cut key bits being offset and the axis of a corresponding tumbler in accordance with the position of the offset chisel point.

5. A key as in claim 4 wherein there are adjacent offset V-shaped cuts at one or more tumbler positions for master-keying purposes.

6. A cylinder lock comprising:

(a) a lock shell;

(b) a plug rotatable in the shell;

(c) a plurality of pin tumblers, at least some of the pin tumblers movable reciprocably and oscillatably about their longitudinal axis;

(d) means defining a tip configuration of the tip of each oscillatable pin tumbler so as to allow oscillation of such tumbler by a bit configuration on a key; and (e) the pin tumbler tip configuration defining means being selectively offset from the longitudinal axis of the tumbler to provide additional combination possibilities for the lock and to allow for master keying.

7. A cylinder lock as in claim 6 wherein the tumbler configuration has opposing tapered faces.

8. A cylinder lock as in claim 7 wherein the tapered faces meet at a line below the tip of the tumbler.

9. A cylinder lock as in claim 8 wherein the line is selectively positioned either on the axis of the tumbler or a predetermined distance on either side of the axis of the cylinder forwardly or rearwardly of such axis.

10. A cylinder lock as in claim 6 further comprising a proper bitted key blade for contacting the tip configuration means to reciprocate each tumbler to a proper position and to oscillate each oscillatable tumbler in either direction through a proper angle.

11. A pin tumbler for a cylinder lock, the tumbler having a central longitudinal axis about which it is oscillatable and reciprocable for operation of the cylinder lock after being moved axially and rotatably by a proper bitted key, the tumbler including a cylindrical body, a key-contacting tip on one end of the body, flat tapered faces on opposite sides of the tip forming a generally chisel-shaped point, with improvements comprising, one of the tapered faces being larger than the other so that the chisel-shaped point is displaced a predetermined distance from the axis of the tumbler.

12. A pin tumbler as in claim 11 wherein the planes of the flat tapered faces meet in a line which is below the tip of the tumbler body and offset from the axis of the tumbler so that the end of the tumbler tip is flat between the tapered faces.

13. A twisting tumbler cylinder lock with a large number of possible combinations and suitable for master-keying, the lock comprising: a cylinder plug rotatable in a cylinder shell under control of a plurality of twisting tumblers, each at a separate tumbler position, with improvements comprising, key-contactable surface means for allowing actuation of the twisting tumblers from one of at least two preselected key-contactable points at each tumbler position, one of the points being offset from the tumbler axis.

14. A twisting tumbler cylinder lock as in claim 13 further comprising a proper bitted key having tumbler actuating surface means for at least one or more of the prescribed points.

15. A twisting tumbler cylinder lock as in claim 13 wherein the means for allowing actuation of the twisting tumblers from at least two prescribed points at each tumbler position is a generally chisel-shaped point on the tip of the tumbler, the point being selectively on or offset from the tumbler axis.

16. A twisting tumbler cylinder lock as in claim 15 wherein there are two offset positions, one forward and one rearward of the tumbler axis.

17. A key for use with a twisting tumbler cylinder lock according to claim 13 in which at least some of the tumblers have offset chisel points on their tips, the lock being a multi-tumbler lock with a plurality of tumbler positions, the key comprising, a key blade and a key bow, the blade extending longitudinally from the bow and having a key section corresponding to a key way of the lock, the key blade containing a plurality of key bits, one key bit for each tumbler position, the key bits being generally V-shaped, the apex of the V-shaped bits being offset from the center of each tumbler position for each tumbler having an offset chisel point at its tip in accordance with the position of the offset chisel point.

18. A key as in claim 17 further comprising at least one skew-shaped, V-shaped cut for rotating the tumblers via contact with the chisel points.

19. A key as in claim 18 wherein there are at least two angles on either side of center for selected ones of the skew-shaped, V-shaped cuts.

* * * * *